US005255841A

United States Patent [19]

Ritter

[11] Patent Number: 5,255,841

[45] Date of Patent: Oct. 26, 1993

[54] COMBINED TIER SHEET AND TOTE BOX

[75] Inventor: Dale L. Ritter, Memphis, Tenn.

[73] Assignee: International Paper Company, Purchase, N.Y.

[21] Appl. No.: 942,879

[22] Filed: Sep. 10, 1992

[51] Int. Cl.[5] ..... B65D 5/22; B65D 19/40

[52] U.S. Cl. ..... 229/103; 206/386; 229/177; 229/179

[58] Field of Search ..... 229/103, 114, 177, 178, 229/179, 186, 188; 206/386, 597

[56] References Cited

U.S. PATENT DOCUMENTS

| | | | |
|---|---|---|---|
| 888,201 | 5/1908 | Strauss | 229/103 |
| 1,508,733 | 9/1924 | Trabold | 229/103 |
| 3,037,682 | 6/1962 | Daubert | 229/103 |
| 3,097,782 | 7/1963 | Koropatkin et al. | 229/103 |
| 3,131,849 | 5/1964 | Paige | 229/179 |
| 3,195,265 | 7/1965 | Marquez et al. | 446/73 |
| 3,440,747 | 4/1969 | Oliver | 446/73 |
| 3,497,128 | 2/1970 | Harvey | 229/120 |
| 3,861,279 | 1/1975 | Maling | 493/343 |
| 4,244,472 | 1/1981 | Brown | 206/597 |
| 4,648,548 | 3/1987 | Shin | 229/117.14 |
| 4,648,549 | 3/1987 | Trutna | 229/177 |
| 4,735,356 | 4/1988 | Engel | 229/103 |
| 4,913,290 | 4/1990 | deGroot | 206/597 |
| 5,035,323 | 7/1991 | Daniels et al. | 206/597 |

FOREIGN PATENT DOCUMENTS

| | | | |
|---|---|---|---|
| 2530219 | 1/1984 | France | 229/179 |

*Primary Examiner*—Gary E. Elkins
*Attorney, Agent, or Firm*—Michael J. Doyle

[57] ABSTRACT

An initially flat and unfolded sheet of corrugated paperboard is cut and scored to first serve as a tier sheet or separator between tiers or layers of products loaded on a pallet and then, when foldably connected integral parts of it are erected, as a tote box thereby comprising a dual function device.

5 Claims, 3 Drawing Sheets

FIG. 1
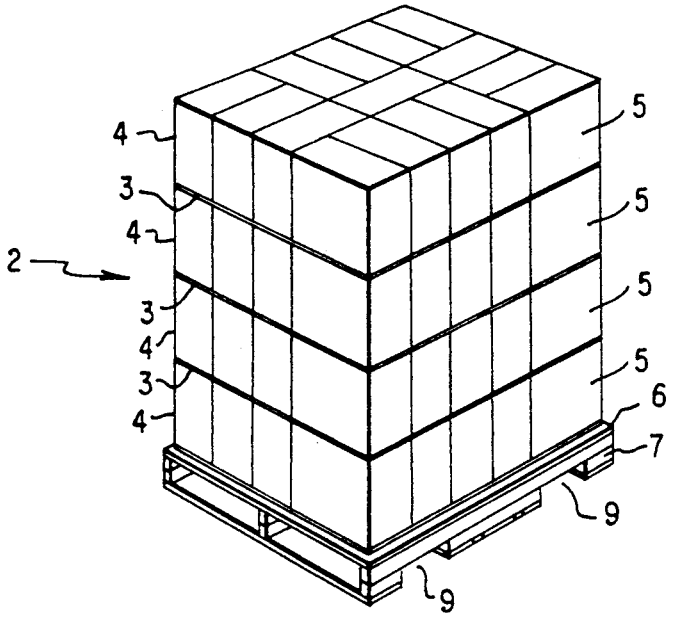
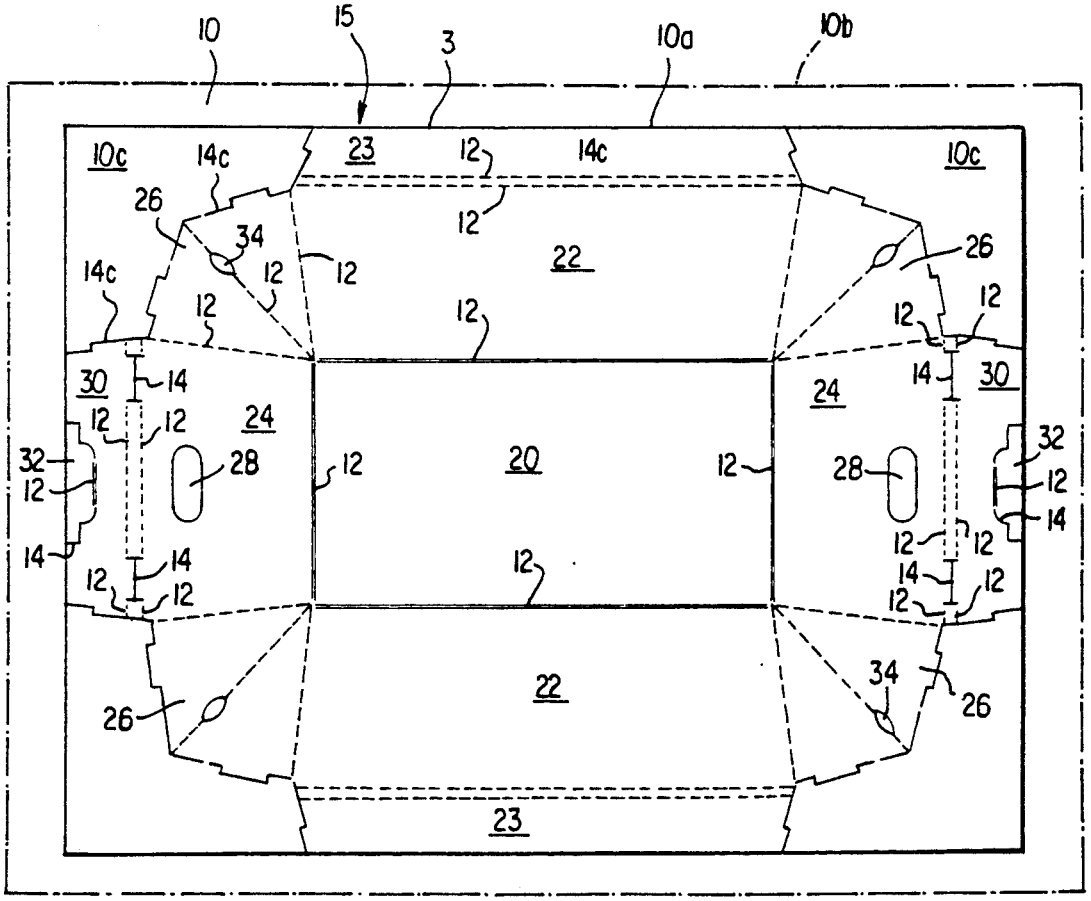
FIG. 2

FIG. 3
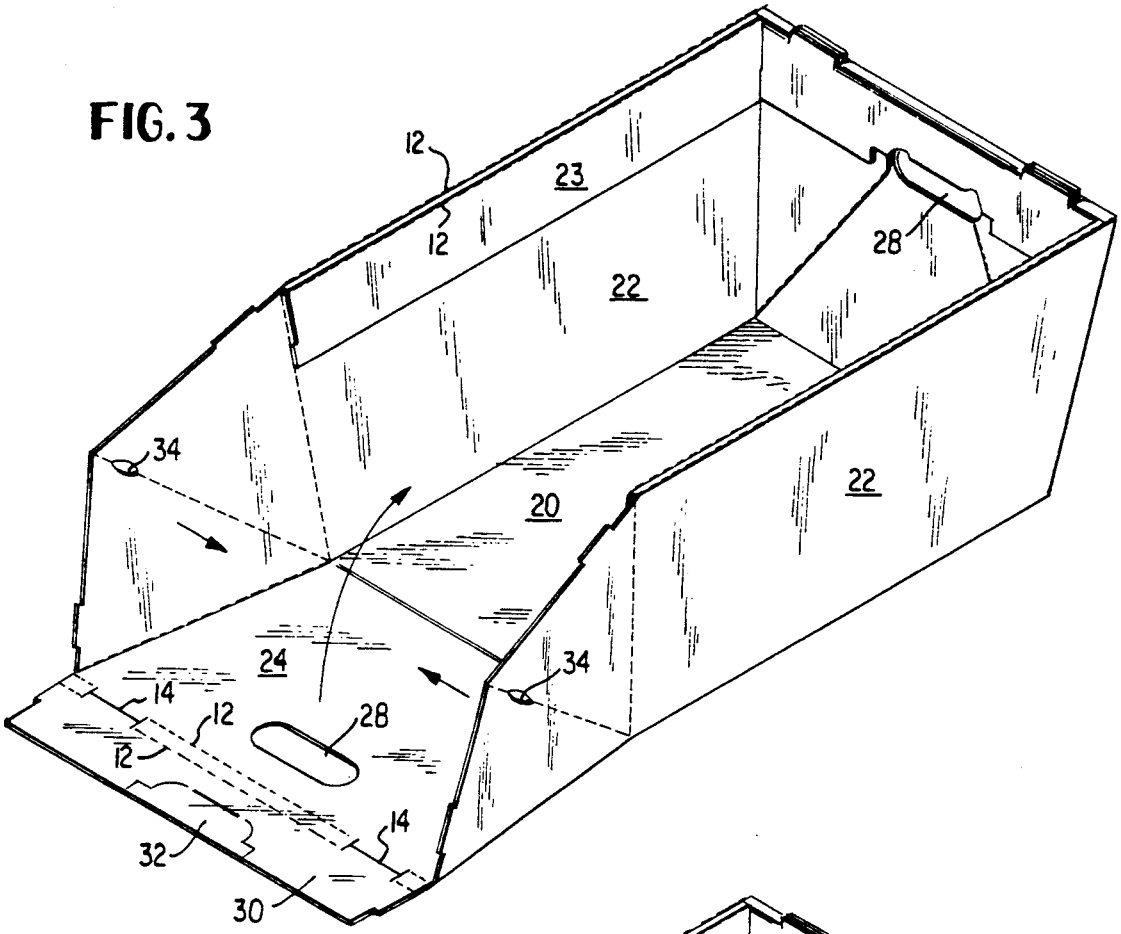
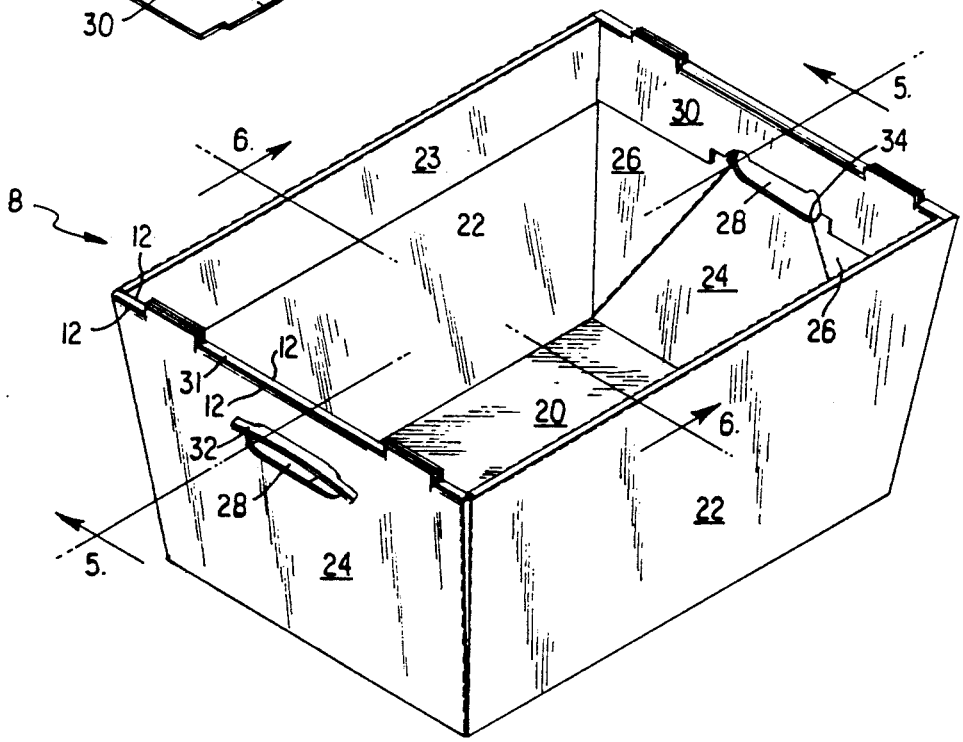
FIG. 4

COMBINED TIER SHEET AND TOTE BOX

BACKGROUND OF THE INVENTION

In the packaging and shipping industries "palletizing" is one method of shipping many products in one package. The products are stacked in layers or tiers one on top of the other and secured on pallets. These are usually wooden structures with load decks spaced upwardly so that the arms of a fork-lift truck can be inserted underneath to lift and move the pallet and its load. It is desireable to separate and thereby protect the layers or tiers of products stacked on the pallet with separators called tier sheets. These are usually flat unfolded sheets of corrugated paperboard.

In the absence of any other function, these tier sheets become items disposable by the ton as waste or for recycling and of no further use to the receiver of the shipment.

It is therefore, desirable and the main object of this invention to provide a further use for the corrugated sheets after they have served their purpose as tier sheets.

SUMMARY OF THE INVENTION

The invention comprises an initially flat and unfolded rectangular sheet of corrugated paperboard dimensioned to serve as a separator called a tier sheet when placed between layers, called tiers, of products loaded in a pallet. It is die-stamped and scored so that after its initial use as a tier sheet, its periphery can be manually torn away as necessary to yield a box blank with foldably connected panel portions and corner gusset parts which can then be manually folded to produce a general purpose open top tote box useful for hand carrying items placed in the box.

The blank has bottom, side, and end panel portions which are foldably interconnected with each other and also foldable corner gusset portions between respective side and end panel portions.

The outside dimensions of the tier sheet may be variably made to accommodate and be commensurate with the outside dimensions of the product tiers with which it will be used by adjusting the dimensions of the removable initial periphery while the dimensions of the box blank itself may, for practical reasons, remain constant.

BRIEF DESCRIPTION OF THE DRAWINGS

FIG. 1 is a perspective view of a loaded pallet with tier sheets between and separating the layers or tiers of products comprising the load.

FIG. 2 is a plan view of the tier sheet of the invention laid out flat and unfolded.

FIG. 3 is a perspective view of a partially completed tote box formed from the blank of FIG. 2.

FIG. 4 is a perspective view of a tote box completed and ready for use as such, formed from the blank of FIG. 2.

DETAILED DESCRIPTION OF THE INVENTION

Figure 5:
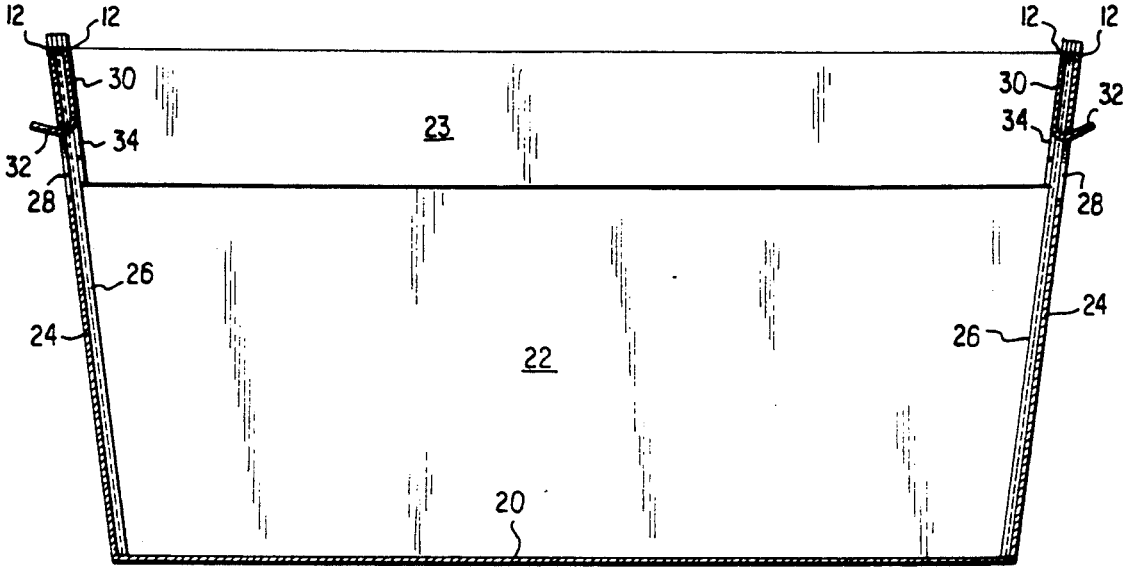
FIG. 5 is a view of the tote box taken along section 5—5 of FIG. 4.
Figure 6:
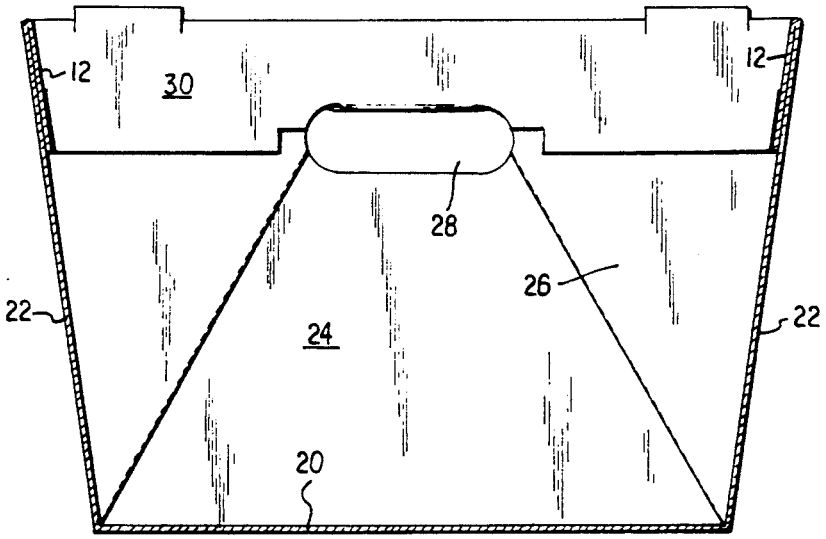
FIG. 6 is a view of the tote box taken along section 6—6 of FIG. 4.

In FIG. 1 a loaded pallet is indicated at 2 with tier sheets of the invention 3 disposed between layers or tiers 4 of products 5 loaded on the platform 6 of a pallet

7. The platform 6 is supported slightly raised so to provide spaces 9 in which the arms of a commonly known fork-lift truck may be inserted to lift and move the entire loaded pallet 2.

The tier sheet 3 of FIG. 2 may have a peripheral portion 10 which is severable from a box blank portion indicated at 15 and whose outside edge 10*a* or 10*b* may be variably arranged in extent, as shown, to accommodate the dimensions of the pallet 7 and its tiers 4 of products.

The tier sheet 3 has lines of weakness including scores 12 to form fold lines and intermittent cuts 14, 14*c* to provide severability. If the outside edge of the tier sheet 3 is along the edge 10*a*, then only the corner portions 10*c* of the periphery 10 are removed along the cuts 14*c* to form the box blank 15.

If the tier sheet extends to the edge 10*b*, then the edge 10*a* will be in the form of intermittent cuts and the outer periphery 10 will be removed from it along with the corner portions 10*c*.

More specifically, the box blank 15 formed in the tier sheet 3 has a central panel portion 20 for forming a box bottom, side panel portions 22 with reinforcing flaps 23 for forming side panels, end panel portions 24 for forming box end panels, and foldable gusset portions 26 between successive side and corner panel portions 22 and 24.

The above described panel and corner portions are respectively foldably connected to each other and are integral with the blank 15 in the tier sheet 3 as a whole.

The end panel portions 24 have hand holes 28 for convenience in hand lifting and carrying the erected tote box indicated at 8 in FIG. 4. They also have outwardly extending flaps 30 which are severed from the end panels by cuts 14 but connected by scores 12. The latter provide fold lines for forming top end edges 31 to the tote box as seen in FIG. 4. The flaps 30 have partially severable and foldable locking tabs 32 which, as seen in FIG. 4, are folded outwardly through the handholes 28 to lock the end flaps 30 downwardly and outwardly against the insides of the end panels 24 and the now inwardly folded corner gussets 26.

The corner gussets 26 have oval shaped cutouts 34 which assume crescent shapes when the corner gussets 26 are folded in along the fold lines 12 so as to clear and thereby avoid obscuring the ends of the hand holes 28 which they partially cover when infolded.

It will thus be seen that the main object of the invention is achieved, to provide a double function product, serving first as a tier sheet for use with pallets and then as a box blank and box.

I claim:

1. A dual function corrugated paperboard sheet dimensioned while in an initially flat and unfolded condition so as to be commensurate in an area with a pallet, said sheet having box blank forming panels and thereby being capable of serving first as a tier sheet separator between tiers of products loaded on a pallet and thereafter as a box blank, said sheet including:

a) a central panel for forming a box bottom, b) side panels for forming box side panels, c) end panels for forming box end panels, d) score lines between and joining said panels and defining each panel and permitting folding as between them to effect erection into a box, said sheet having peripheral removable portions which when removed leave only said foldable box forming panels.

2. The sheet as set forth in claim 1 in combination with a loaded pallet and arranged between load layers in the pallet.

3. The sheet as set forth in claim 1 including gusset corner portions between successive side and end panel portions, and in which said end panels have hand holes for convenience in hand lifting and carrying a box erected from said sheet.

4. The sheet as set forth in claim 3 in which said end panel portions have outwardly extending flaps partially severed by cuts and connected by scores, said cuts and scores being non-coincident.

5. The sheet as set forth in claim 4 in which said outwardly extending flaps on said end panel portions have partially severable locking tabs capable of being inserted through holes preformed in said end panel portions.

* * * * *